US010559255B2

(12) United States Patent
Han et al.

(10) Patent No.: US 10,559,255 B2
(45) Date of Patent: Feb. 11, 2020

(54) ORGANIC LIGHT-EMITTING DIODE DRIVING CIRCUIT, DRIVING METHOD, DISPLAY SUBSTRATE, AND DISPLAY APPARATUS

(71) Applicants: BOE TECHNOLOGY GROUP CO., LTD., Beijing (CN); CHENGDU BOE OPTOELECTRONICS TECHNOLOGY CO., LTD., Chengdu, Sichuan Province (CN)

(72) Inventors: Wenchu Han, Beijing (CN); Fucheng Yang, Beijing (CN); Zihe Zhang, Beijing (CN); Hongwei Dai, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu, Sichuan Province (CN)

( * ) Notice: Subject to any disclaimer, the term of this patent is extended or adjusted under 35 U.S.C. 154(b) by 0 days.

(21) Appl. No.: 15/981,061

(22) Filed: May 16, 2018

(65) Prior Publication Data

US 2019/0206317 A1 Jul. 4, 2019

(30) Foreign Application Priority Data

Jan. 2, 2018 (CN) ..... 2018 1 0002571

(51) Int. Cl.
*G09G 3/30* (2006.01)
*G09G 3/3233* (2016.01)
(Continued)

(52) U.S. Cl.
CPC ..... *G09G 3/3233* (2013.01); *G09G 3/3225* (2013.01); *G09G 2300/0819* (2013.01);
(Continued)

(58) Field of Classification Search
CPC ..... G09G 3/325; G09G 3/3225; G09G 3/3233
(Continued)

(56) References Cited

U.S. PATENT DOCUMENTS

2006/0221662 A1* 10/2006 Park ..... G09G 3/3233 365/145
2007/0040769 A1* 2/2007 Tai ..... G09G 3/3233 345/76
(Continued)

FOREIGN PATENT DOCUMENTS

CN 1909038 A 2/2007
CN 1910642 A 2/2007
(Continued)

OTHER PUBLICATIONS

First Office Action for CN Application No. 201810002571.7 dated Jun. 18, 2019.

*Primary Examiner* — Adam J Snyder
(74) *Attorney, Agent, or Firm* — Foley & Lardner LLP; James F. Ewing; Paul M. H. Pua

(57) ABSTRACT

Present disclosure provides OLED driving circuit, comprising: first switch unit, electrically connected between first end of first capacitor and data input end; second switch unit, electrically connected between second end of first capacitor and data input end; third switch unit, its first end electrically connected to voltage input end, its second end electrically connected to OLED, its third end electrically connected to first end of first capacitor, third switch unit configured to switch connection and disconnection between first and second ends of third switch unit; fourth switch unit, its first end electrically connected to first end of first capacitor, its second end electrically connected to second end of third switch unit; wherein first and second ends of second capacitor are electrically connected to voltage input end and
(Continued)

second end of first capacitor, respectively. Present disclosure further provides OLED driving method, display substrate and display apparatus.

9 Claims, 6 Drawing Sheets

(51) Int. Cl.
*G09G 3/10* (2006.01)
*G09G 3/3225* (2016.01)

(52) U.S. Cl.
CPC ..... *G09G 2300/0876* (2013.01); *G09G 2320/0233* (2013.01)

(58) Field of Classification Search
USPC ..... 345/76; 315/169.3
See application file for complete search history.

(56) References Cited

U.S. PATENT DOCUMENTS

2008/0036706 A1* 2/2008 Kitazawa ..... G09G 3/3233 345/76
2008/0170011 A1* 7/2008 Kohno ..... G09G 3/3233 345/77
2009/0309865 A1* 12/2009 Kohno ..... G09G 3/3233 345/213
2010/0039411 A1* 2/2010 Yatabe ..... G09G 3/3233 345/204
2012/0038617 A1* 2/2012 Chung ..... G09G 3/3233 345/212
2012/0306843 A1* 12/2012 Wang ..... G09G 3/3258 345/212
2014/0071028 A1* 3/2014 Han ..... G09G 3/3266 345/77
2015/0070407 A1* 3/2015 Lee ..... G09G 3/3233 345/690

FOREIGN PATENT DOCUMENTS

CN 103578413 A 2/2014
CN 104575341 A 4/2015
CN 105427811 A 3/2016
CN 105575331 A 5/2016
KR 20050109164 A 11/2005

* cited by examiner

ORGANIC LIGHT-EMITTING DIODE DRIVING CIRCUIT, DRIVING METHOD, DISPLAY SUBSTRATE, AND DISPLAY APPARATUS

CROSS-REFERENCE TO RELATED APPLICATIONS

The present application claims priority to Chinese Application No. 201810002571.7, as filed on Jan. 2, 2018. The disclosure of the aforementioned Chinese patent application is fully incorporated herein by reference.

TECHNICAL FIELD

The present disclosure relates to an organic light-emitting diode driving circuit, an organic light-emitting diode driving method, a display substrate, and a display apparatus.

BACKGROUND

As compared with a conventional liquid crystal display panel, an Organic Light-Emitting Diode (OLED) display panel has a faster reaction speed and a wider view angle, and is an important development direction of future display techniques.

In a current OLED display panel, a current that drives the OLED is related to a threshold voltage that drives the transistor, so an luminous intensity of the OLED is also related to the threshold voltage that drives the transistor.

SUMMARY

According to one or more embodiments of the present disclosure, an OLED driving circuit is provided, comprising a data input end, a first capacitor, a second capacitor, a voltage input end, and an OLED. The OLED driving circuit further comprises a first switch unit, a second switch unit, a third switch unit, and a fourth switch unit. The first switch unit is electrically connected between a first end of the first capacitor and the data input end. The second switch unit is electrically connected between a second end of the first capacitor and the data input end. A first end of the third switch unit is electrically connected to the voltage input end, a second end of the third switch unit is electrically connected to the OLED, a third end of the third switch unit is electrically connected to the first end of the first capacitor, and the third switch unit is configured to switch connection and disconnection between the first and second ends of the third switch unit. A first end of the fourth switch unit is electrically connected to the first end of the first capacitor, and a second end of the fourth switch unit is electrically connected to the second end of the third switch unit. In addition, a first end of the second capacitor is electrically connected to the voltage input end, and a second end of the second capacitor is electrically connected to the second end of the first capacitor.

In one or more embodiments, the OLED driving circuit further comprises a first signal input, a second signal input, and a third signal input.

The first signal input is electrically connected to the first switch unit, for transmitting an ON signal to the first switch unit during a first time period, and transmitting an OFF signal to the first switch unit during second, third, and fourth time periods.

The second signal input is electrically connected to the second switch unit, for transmitting an ON signal to the second switch unit during the first, second, and third time periods, and transmitting an OFF signal to the second switch unit during the fourth time period.

The third signal input is electrically connected to the fourth switch unit, for transmitting an ON signal to the fourth switch unit during the second time period, and transmitting an OFF signal to the fourth switch unit during the first, third, and fourth time periods.

In this embodiment, the data input end is used for receiving a first voltage signal during the first, second, and fourth time periods, and receiving a second voltage signal during the third time period, the first voltage signal being greater than a turn-on voltage of the third switch unit.

In one or more embodiments, the OLED driving circuit further comprises a fifth switch unit, which is electrically connected between the second end of the third switch unit and the OLED.

In one or more embodiments, the OLED driving circuit further comprises a fourth signal input, which is electrically connected to the fifth switch unit for transmitting an ON signal to the fifth switch unit during the fourth time period and transmitting an OFF signal to the fifth switch unit during the first, second and third time periods.

In one or more embodiments, the fifth switch unit is a transistor.

In one or more embodiments, at least one of the first, second, third, and fourth switch units is a transistor.

According one or more embodiments of the present disclosure, an OLED driving method adapted for the aforementioned OLED driving circuit is provided. The OLED driving method comprises:

during a first time period, transmitting an ON signal to the first switch unit, transmitting an ON signal to the second switch unit, transmitting an OFF signal to the fourth switch unit, and receiving a first voltage signal through the data input end, the first voltage signal being greater than an turn-on voltage of the third switch unit;

during a second time period, transmitting an OFF signal to the first switch unit, transmitting an ON signal to the second switch unit, transmitting an ON signal to the fourth switch unit, and receiving a first voltage signal through the data input end;

during a third time period, transmitting an OFF signal to the first switch unit, transmitting an ON signal to the second switch unit, transmitting an OFF signal to the fourth switch unit, and receiving a second voltage signal through the data input end;

during a fourth time period, transmitting an OFF signal to the first switch unit, transmitting an OFF signal to the second switch unit, transmitting an OFF signal to the fourth switch unit, and receiving a first signal voltage through the data input end.

In one or more embodiments, the OLED driving circuit further comprises a fifth switch unit which is electrically connected to the second end of the third switch unit and to the OLED. In this embodiment, the method further comprises:

transmitting an OFF signal to the fifth switch unit during the first, second, and third time periods, and transmitting an ON signal to the fifth switch unit during the fourth time period.

According to one or more embodiments of the present disclosure, a display substrate comprising the aforementioned OLED driving circuit is provided.

According to one or more embodiments of the present disclosure, a display apparatus comprising the aforementioned display substrate is provided.

It should be understood that, the above general descriptions and the following detailed descriptions are only exemplary and explanatory, and cannot be used to limit the present disclosure.

BRIEF DESCRIPTION OF THE DRAWINGS

The accompanying drawings therein are incorporated into the Description and serve as a portion of the Description, which illustrate embodiments that comply with the present disclosure and are used together with the Description for explaining the principle of the present disclosure.

DETAILED DESCRIPTION

Figure 1:
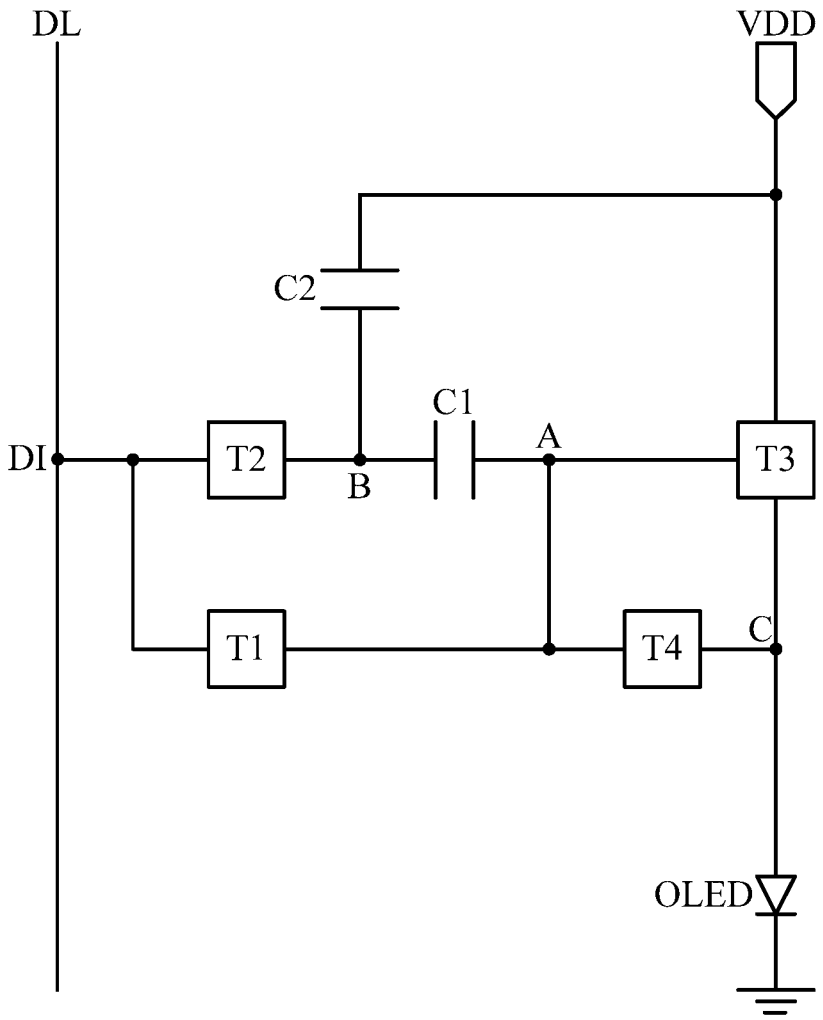
FIG. 1 is a structural schematic diagram of the OLED driving circuit as illustrated according to one or more embodiments of the present disclosure.

Explanations are given in detail for exemplary embodiments herein, which are denoted in the drawings as examples. When the following descriptions relate to the drawings, identical digits in different drawings represent identical or similar elements, unless otherwise indicated. Embodiment modes as described in the following exemplary embodiments are not used to represent all the embodiment modes that coincide with the present disclosure. On the contrary, they are only examples of the apparatus and the method that are described in detail in the appending Claims and coincide with some aspects of the present disclosure.

FIG. 1 is a structural schematic diagram of the OLED driving circuit as illustrated according to one or more embodiments of the present disclosure. The OLED driving circuit according to this embodiment may be adapted for a display substrate. The display substrate may include a plurality of pixels, each of which may include a plurality of sub-pixels. The sub-pixel may be provided with the OLED driving circuit as shown in FIG. 1, for driving the OLED in the sub-pixel to emit light.

As shown in FIG. 1, the OLED driving circuit comprises a data input end DI, a first capacitor C1, a second capacitor C2, a voltage input end VDD, and an Organic Light-Emitting Diode OLED. In addition, the OLED driving circuit further comprises a first switch unit T1, a second switch unit T2, a third switch unit T3, and a fourth switch unit T4. The data input end DI is connected to a data line DL, and configured to receive a data signal from the data line DL.

The first switch unit T1 is electrically connected between a first end (point A) of the first capacitor C1 and the data input end DI. The second switch unit T2 is electrically connected between a second end (point B) of the first capacitor C1 and the data input end DI. A first end of the third switch unit T3 is electrically connected to the voltage input end VDD, a second end (point C) of the third switch unit T3 is electrically connected to the Organic Light-Emitting Diode OLED, a third end of the third switch unit is electrically connected to the first end of the first capacitor C1. A first end of the fourth switch unit T4 is electrically connected to the first end (point A) of the first capacitor C1, and a second end of the fourth switch unit T4 is electrically connected to the second end (point C) of the third switch unit T3. A first end of the second capacitor C2 is electrically connected to the voltage input end VDD, and a second end of the second capacitor C2 is electrically connected to the second end (point B) of the first capacitor C1.

In one embodiment, the light-emitting period of the OLED may be divided into four time periods.

In particular, during a first time period, an ON signal may be transmitted to the first switch unit T1, an ON signal may be transmitted to the second switch unit T2, an OFF signal may be transmitted to the fourth switch unit T4, and a first voltage signal $V_{int}$ may be received through the data input end DI.

During the first time period, the first switch unit T1 and the second switch unit T2 may be turned on, such that the data input end DI charges the first and second ends of the first capacitor C1 with the first voltage signal $V_{int}$, thus causing point A and point B to have a voltage of $V_{int}$. In particular, the first voltage signal $V_{int}$ is greater than a turn-on voltage of the third switch unit T3, such that the third switch unit T3 may be turned on, and a voltage VDD input from the voltage input end VDD is transmitted to point C through the third switch unit T3.

It should be noted that, the voltage VDD may be set as required. The voltage VDD may be different from the voltage signal $V_{int}$, for example, if the first voltage signal $V_{int}$ is a negative voltage, then the voltage VDD may be a positive voltage. Typically in case where the first voltage signal $V_{int}$ is a negative voltage and the voltage VDD is a positive voltage, an embodiment of the present disclosure is illustrated below.

During the second time period, an OFF signal is transmitted to the first switch unit T1, an ON signal is transmitted to the second switch unit T2, an ON signal is transmitted to the fourth switch unit T4, and the first voltage signal $V_{int}$ is received through the data input end DI.

During the second time period, the first switch unit T1 may be turned off, the fourth switch unit T4 may be turned on, the data input end DI does not charge point A any longer. Point C is connected to point A through the fourth switch unit T4, so the voltage input end VDD may charge point A through point C, until a voltage of point A is increased to be insufficient to turn on the third switch unit T3. For example, the third switch unit T3 is a transistor, then a voltage of point A is $VDD-|V_{th}|$, where $V_{th}$ is a threshold voltage of the third switch unit T3.

During the third time period, an OFF signal is transmitted to the first switch unit T1, an ON signal is transmitted to the second switch unit T2, an OFF signal is transmitted to the fourth switch unit T4, and a second voltage signal $V_{data}$ is received through the data input end DI.

During the third time period, since the fourth switch unit T4 is turned off and the second switch unit T2 is still ON, the data input end DI may transmit the second voltage signal $V_{data}$ to point B, such that a voltage of point B is changed from the first voltage signal $V_{int}$ to the second voltage signal $V_{data}$. For example, $V_{data}$ is less than or equal to $V_{int}$, and then a voltage variation of point B is $V_{int}-V_{data}$.

Since the voltage of point B is changed, based on the coupling effect of the first capacitor C1, the voltage of point A will also be accordingly changed, by $V_{int}-V_{data}$, to $VDD-|V_{th}|-(V_{int}-V_{data})$. That is, the voltage of point A is decreased, such that the third switch unit T3 may be turned on.

During the fourth time period, an OFF signal is transmitted to the first switch unit T1, an OFF signal is transmitted to the second switch unit T2, an OFF signal is transmitted to the fourth switch unit T4, and the first voltage signal $V_{int}$ is received through the data input end DI.

During the fourth time period, by turning off the second switch unit T2, the input data DI does not transmit a voltage signal to point B any more. The second capacitor C2 may serve a function of maintaining the voltage of point B, so as to maintain the voltage of point B at $V_{int}-V_{data}$, and accordingly maintain the voltage of point A at $VDD-|V_{th}|-(V_{int}-V_{data})$.

A current of the OLED is calculated using a formula $$I_{OLED} = \frac{1}{2}\beta(V_{sg} - |V_{th}|)^2,$$

where, β is a parameter related to process parameters and feature sizes of the third switch unit T3, and Vgs is a voltage difference between a source and a gate of the third switch unit T3, namely a voltage difference between point C and point A.

During the four time period, the voltage of point A is $VDD-|V_{th}|-(V_{int}-V_{data})$, the voltage of point C is VDD, so $V_{gs}=VDD-[VDD-|V_{th}|-(V_{int}-V_{data})]=|V_{th}|+(V_{int}-V_{data})$. $V_{gs}$ is substituted into the aforementioned formula of $I_{OLED}$ to derive $$I_{OLED} = \frac{1}{2}\beta(V_{int} - V_{data})^2.$$

The resultant OLED current $I_{OLED}$ is independent of the threshold voltage $V_{th}$ of the third switch unit T3, such that it may be guaranteed that the luminous intensity of the OLED during the fourth time period is not affected by the threshold voltage $V_{th}$ of the third switch unit T3. Thus the stability of the luminous intensity may be guaranteed, such that the display apparatus where the OLED resides has an excellent display effect.

Based on the embodiment as shown in FIG. 1, the first switch unit T1, the second switch unit T2, the third switch unit T3, and the fourth switch unit T4 may be transistors, which may be either PNP-type transistors or NPN-type transistors. Typically, in case where the first switch unit T1, the second switch unit T2, the third switch unit T3, and the fourth switch unit T4 are PNP-type transistors, an embodiment of the present disclosure is illustrated below.

Figure 2:
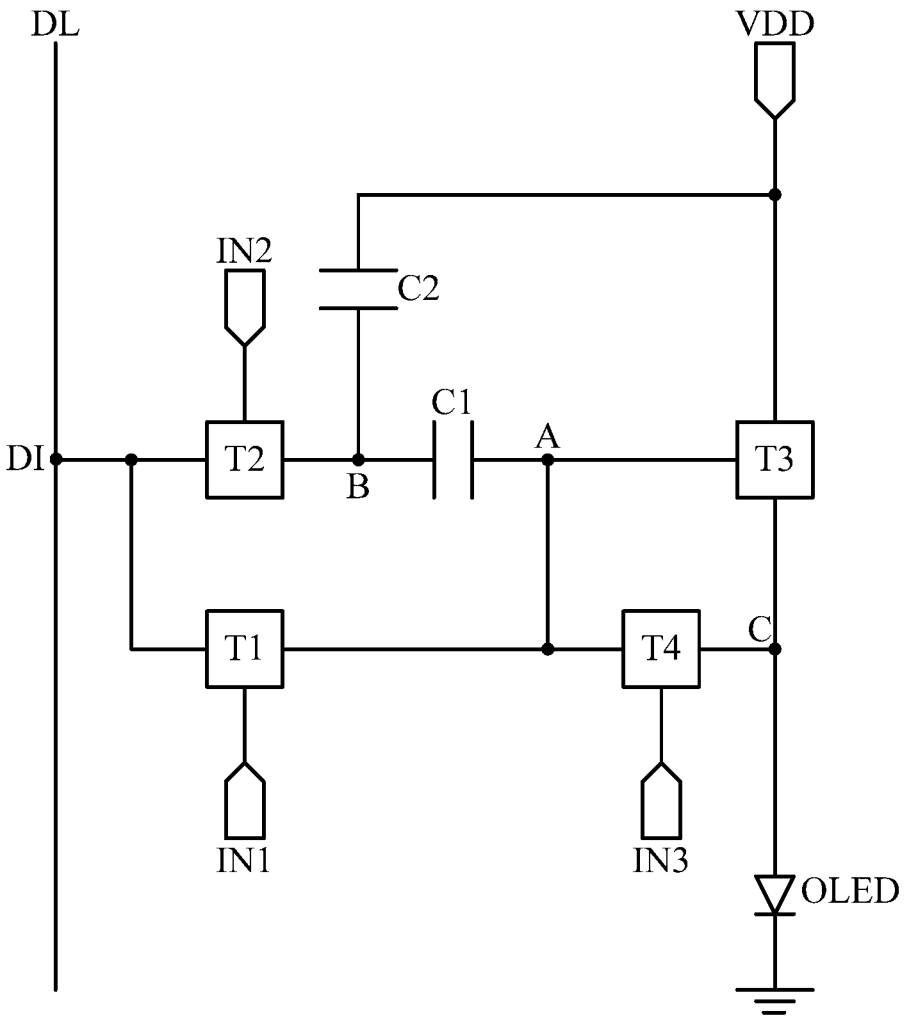
FIG. 2 is a structural schematic diagram of the OLED driving circuit as illustrated according to one or more embodiments of the present disclosure.
Figure 3:
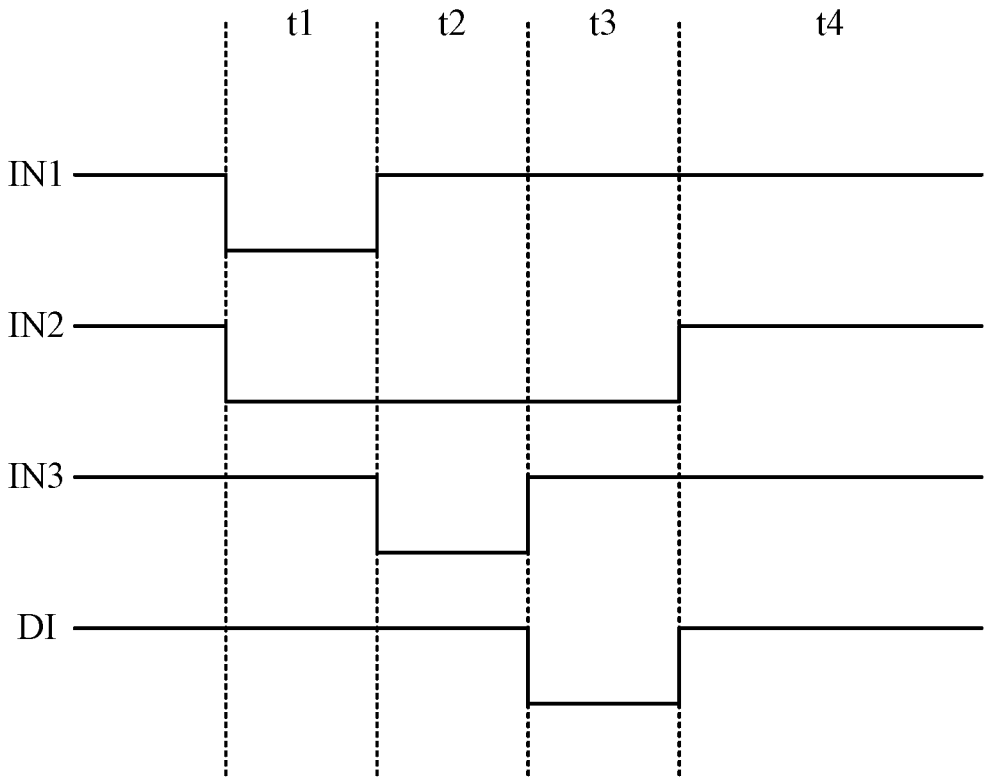
FIG. 3 is a timing diagram of the OLED driving circuit as shown in FIG. 2 and as illustrated according to one or more embodiments of the present disclosure.

FIG. 2 is a structural schematic diagram of the OLED driving circuit as illustrated according to one or more embodiments of the present disclosure. FIG. 3 is a timing diagram of the OLED driving circuit as shown in FIG. 2 and as illustrated according to one or more embodiments of the present disclosure.

As shown in FIGS. 2 and 3, the OLED driving circuit further comprises a first signal input IP1, a second signal input IP2, and a third signal input IP3.

The first signal input IP1 is electrically connected to the first switch unit T1, for transmitting an ON signal to the first switch unit T1 during a first time period t1, and transmitting an OFF signal to the first switch unit T1 during a second time period t2, a third time period t3, and a fourth time period t4.

The second signal input IP2 is electrically connected to the second switch unit T2, for transmitting an ON signal to the second switch unit T2 during the first time period t1, the second time period t2, and the third time period t3, and transmitting an OFF signal to the second switch unit T2 during the fourth time period t4.

The third signal input IP3 is electrically connected to the forth switch unit T4, for transmitting an ON signal to the fourth switch unit T4 during the second time period t2, and transmitting an OFF signal to the fourth switch unit T4 during the first time period t1, the third time period t3, and the fourth time period t4.

In this embodiment, the data input end DI is used for receiving a first voltage signal during the first time period t1, the second time period t2, and the fourth time period t4, and receiving a second voltage signal during the third time period t3. The first voltage signal is greater than a turn-on voltage of the third switch unit.

In one embodiment, for example, the first switch unit T1, the second switch unit T2, the third switch unit T3, and the fourth switch unit T4 are PNP-type transistors, i.e., transistors which are turned-on with low voltage level. Therefore, by inputting a low voltage to a gate of the transistor, the transistor may be turned on, and by inputting a high voltage, the transistor may be turned off.

It should be noted that, in addition to driving the OLED driving circuit by a signal in accordance with a timing set as shown in FIG. 3, the OLED driving circuit as shown in FIG. 1 may be driven by a signal in accordance with a timing set as required.

Figure 4:
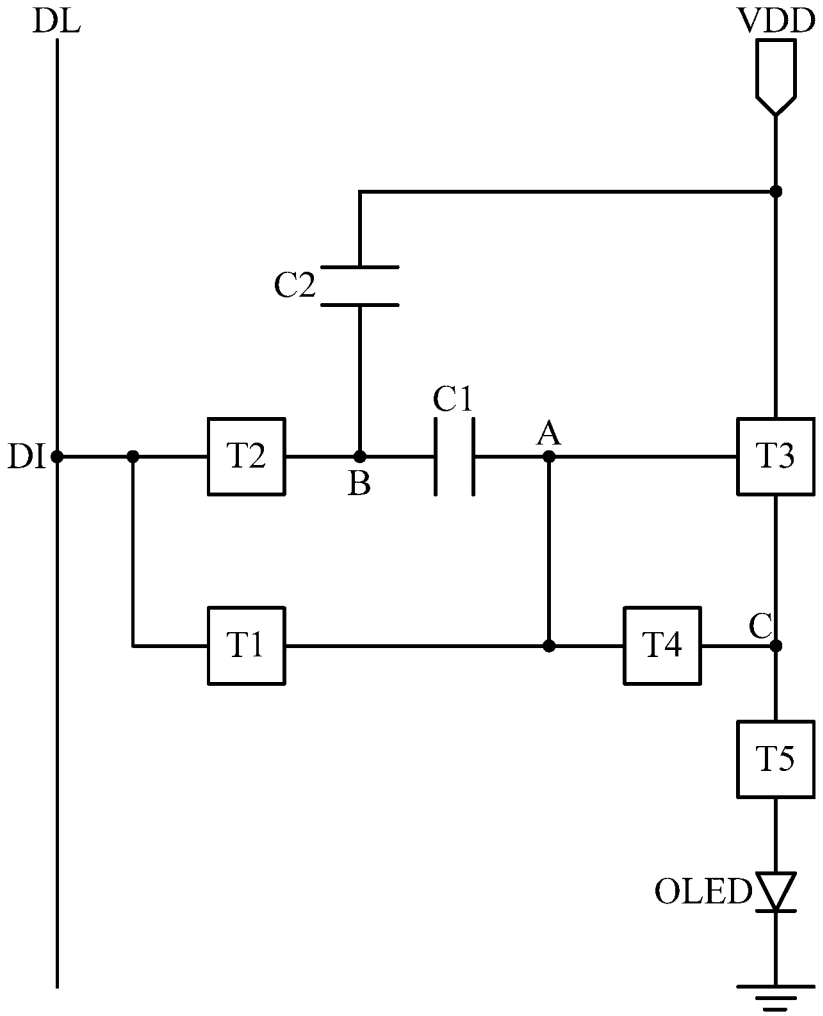
FIG. 4 is a structural schematic diagram of the OLED driving circuit as illustrated according to one or more embodiments of the present disclosure.

FIG. 4 is a structural schematic diagram of the OLED driving circuit as illustrated according to one or more embodiments of the present disclosure. As shown in FIG. 4, the OLED driving circuit further comprises a fifth switch unit T5, which is electrically connected between a second end (point C) of the third switch unit T3 and the OLED.

In one embodiment, by arranging a fifth switch unit T5 between the second end of the third switch unit T3 and the OLED, connection or disconnection between the second end of the third switch unit T3 and the OLED may be controlled as required.

For example, it can be controlled to disconnect the second end of the third switch unit T3 and the OLED during the first, second, and third time periods in the aforementioned embodiment, and it can be controlled to connect the second end of the third switch unit T3 and the OLED during the fourth time period.

Since the current of the OLED is still affected by the threshold voltage of the third switch unit T3 during the first, second, and third time periods, it is controlled to connect the second end of the third switch unit T3 and the OLED during only the fourth time period, causing the OLED to emit light only during the fourth time period, during which the current is not affected by the threshold voltage of the third switch unit T3, which facilitates the guarantee that the OLED has a stable luminance during each of the emission phases, and thus enhances the display effect.

Figure 5:
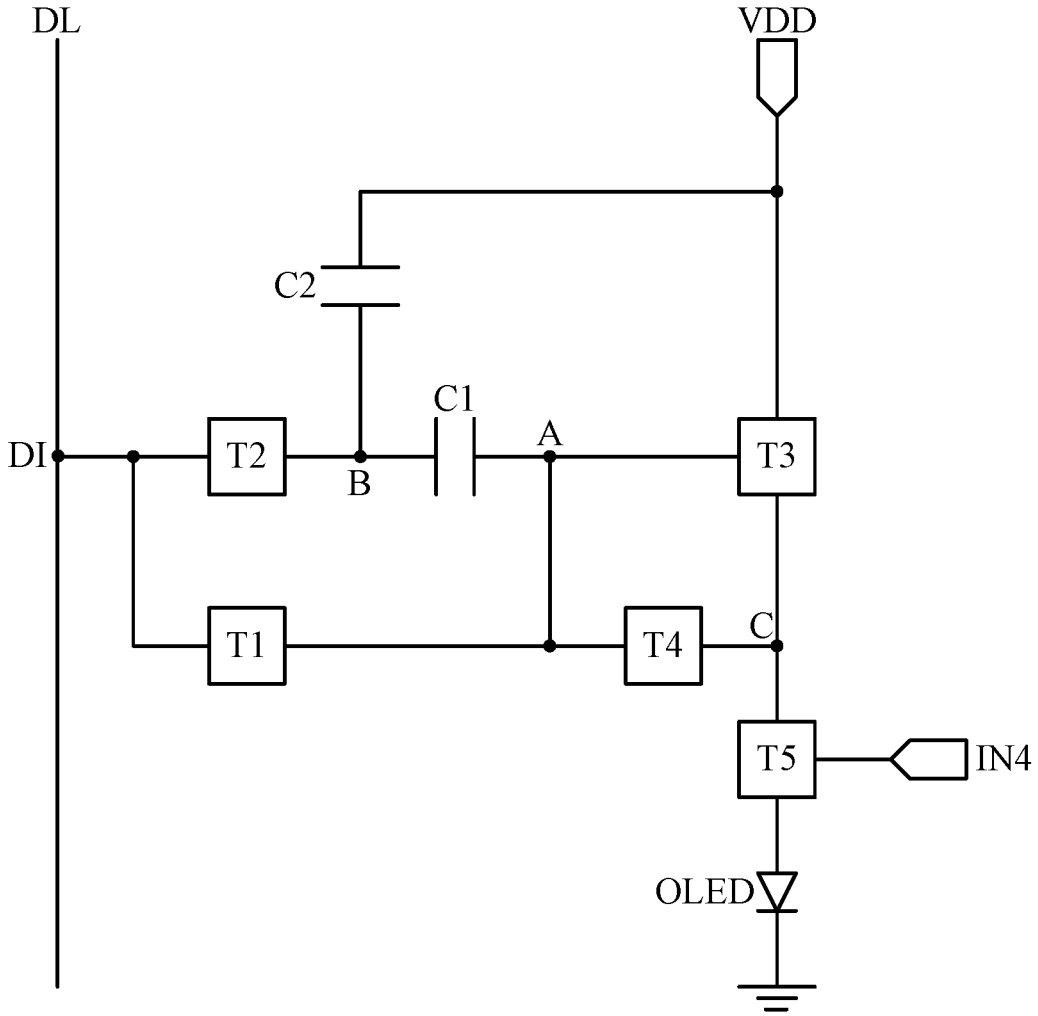
FIG. 5 is a structural schematic diagram of the OLED driving circuit as illustrated according to one or more embodiments of the present disclosure.

FIG. 5 is a structural schematic diagram of the OLED driving circuit as illustrated according to one or more embodiments of the present disclosure. As shown in FIG. 5, on the basis of the embodiment as shown in FIG. 4, the OLED driving circuit further comprises a fourth signal input IN4, which is electrically connected to the fifth switch unit T5 for transmitting an ON signal to the fifth switch unit T5 during the fourth time period.

In one or more embodiments, the fifth switch unit is a transistor.

In one or more embodiments, at least one of the first, second, third, and fourth switch units is a transistor.

Figure 6:
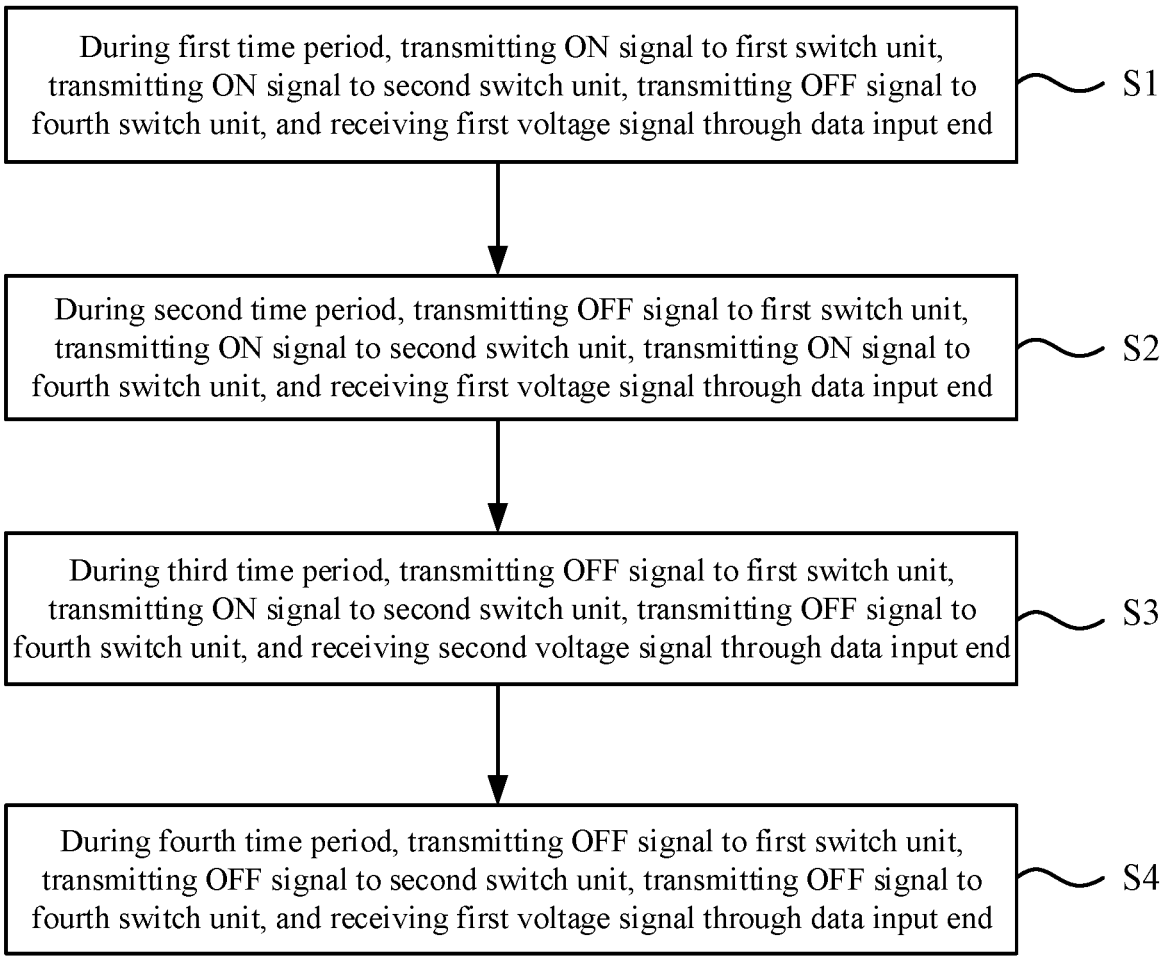
FIG. 6 is a schematic flow diagram of the OLED driving method as illustrated according to one or more embodiments of the present disclosure.

FIG. 6 is a flow schematic diagram of the OLED driving method as illustrated according to one or more embodiments of the present disclosure. The method as illustrated in this embodiment is adapted for the OLED driving circuit according to any one of the aforementioned embodiments. As shown in FIG. 6, the method comprises steps of:

step S1, during the first time period, transmitting an ON signal to the first switch unit, transmitting an ON signal to the second switch unit, transmitting an OFF signal to the fourth switch unit, and receiving a first voltage signal through the data input end;

step S2, during the second time period, transmitting an OFF signal to the first switch unit, transmitting an ON signal to the second switch unit, transmitting an ON signal to the fourth switch unit, and receiving a first voltage signal through the data input end;

step S3, during the third time period, transmitting an OFF signal to the first switch unit, transmitting an ON signal to the second switch unit, transmitting an OFF signal to the fourth time period, and receiving a second voltage signal through the data input end;

step S4, during the fourth time period, transmitting an OFF signal to the first switch unit, transmitting an OFF signal to the second switch unit, transmitting an OFF signal to the fourth switch unit, and receiving a first voltage signal through the data input end.

In one or more embodiments, the OLED driving circuit further comprises a fifth switch unit which is electrically connected to the second end of the third switch unit and to the OLED. In this embodiment, the method further comprises:

during the first, second and third time periods, transmitting an OFF signal to the fifth switch unit, and during the fourth time period, transmitting an ON signal to the fifth switch unit.

An embodiment of the present disclosure further provides a display substrate, comprising the OLED driving circuit according to any one of the aforementioned embodiments.

An embodiment of the present disclosure further provides a display apparatus, comprising the display substrate according to the aforementioned embodiment.

It should be noted that, the display apparatus in this embodiment may be electronic paper, a mobile phone, a tablet PC, a TV set, a laptop, a digital photo frame, a navigator, or any other product or component having a display function.

In the present disclosure, the terms "first", "second", "third", and "fourth" are only for a descriptive purpose, but cannot be understood as an indication or implication of relative importance. The term "plurality" is directed to two or more, unless otherwise indicated.

Upon a consideration of the disclosure of the Description and practice, those skilled in the art readily conceive of other embodiment solutions of the present disclosure. The present disclosure aims at covering any variant, usage or adaptive change of the present disclosure. This variant, usage or adaptive change complies with general principles of the present disclosure and includes common knowledge or customary technical means in the technical art that is not disclosed in the present disclosure. The Description and embodiments are only regarded as being exemplary, and real scope and spirit of the present disclosure are indicated in the following claims.

It should be understood that, the present disclosure is not limited to the above-described precise structures which are shown in the accompanying drawings, and various modifications and changes may be made without deviating from its scope. The scope of the present disclosure is limited only by the appending claims.

The invention claimed is:

1. An Organic Light-Emitting Diode (OLED) driving circuit, comprising a data input end, a first capacitor, a second capacitor, a voltage input end, and an OLED, the OLED driving circuit further comprising:

a first switch unit, electrically connected between a first end of the first capacitor and the data input end;

a second switch unit, electrically connected between a second end of the first capacitor and the data input end;

a third switch unit, a first end of which being electrically connected to the voltage input end, a second end of which being electrically connected to the OLED, and a third end of which being electrically connected to the first end of the first capacitor, the third switch unit being configured to switch connection and disconnection between the first and second ends of the third switch unit;

a fourth switch unit, a first end of which being electrically connected to the first end of the first capacitor, and a second end of which being electrically connected to the second end of the third switch unit;

wherein, a first end of the second capacitor is electrically connected to the voltage input end, and a second end of the second capacitor is electrically connected to the second end of the first capacitor, the OLED driving circuit further comprising:

a first signal input, electrically connected to the first switch unit, for transmitting ON signal to the first switch unit during a first time period, and transmitting OFF signal to the first switch unit during second, third, and fourth time periods;

a second signal input, electrically connected to the second switch unit, for transmitting ON signal to the second switch unit during the first, second, and third time periods, and transmitting OFF signal to the second switch unit during the fourth time period;

a third signal input, electrically connected to the fourth switch unit, for transmitting ON signal to the fourth switch unit during the second time period, and transmitting OFF signal during the first, third, and fourth time periods;

wherein, the data input end is used for receiving a first voltage signal during the first, second, and fourth time periods, and receiving a second voltage signal during the third time period, and the first voltage signal is greater than a turn-on voltage of the third switch unit.

2. The OLED driving circuit according to claim 1, further comprising:

a fifth switch unit, electrically connected between the second end of the third switch unit and the OLED.

3. The OLED driving circuit according to claim 2, further comprising:

a fourth signal input, electrically connected to the fifth switch unit, for transmitting ON signal to the fifth switch unit during the fourth time period, and transmitting OFF signal during the first, second, and third time periods.

4. The OLED driving circuit according to claim 2, wherein, the fifth switch unit is a transistor.

5. The OLED driving circuit according to claim 1, wherein, at least one of the first, second, third, and fourth switch units is a transistor.

6. An OLED driving method, adapted for the OLED driving circuit according to claim 1, the OLED driving method comprising:

during a first time period, transmitting ON signal to the first switch unit, transmitting ON signal to the second switch unit, transmitting OFF signal to the fourth switch unit, and receiving a first voltage signal through the data input end, the first voltage signal being greater than a turn-on voltage of the third switch unit;

during a second time period, transmitting OFF signal to the first switch unit, transmitting ON signal to the second switch unit, transmitting ON signal to the fourth switch unit, and receiving the first voltage signal through the data input end;

during a third time period, transmitting OFF signal to the first switch unit, transmitting ON signal to the second switch unit, transmitting OFF signal to the fourth switch unit, and receiving a second voltage signal through the data input end;

during a fourth time period, transmitting OFF signal to the first switch unit, transmitting OFF signal to the second switch unit, transmitting OFF signal to the fourth switch unit, and receiving the first voltage signal through the data input end.

7. The OLED driving method according to claim 6, wherein, the OLED driving circuit further comprises a fifth switch unit which is electrically connected between the second end of the third switch unit and the OLED, the OLED driving method further comprising:

transmitting OFF signal to the fifth switch unit during the first, second, and third time periods, and transmitting ON signal to the fifth switch unit during the fourth time period.

8. A display substrate, comprising the OLED driving circuit according to claim 1.

9. A display apparatus, comprising the display substrate according to claim 8.

* * * * *